US005795130A

United States Patent [19]

Suenaga et al.

[11] Patent Number: 5,795,130

[45] Date of Patent: Aug. 18, 1998

[54] HEAT RECOVERY TYPE GAS TURBINE ROTOR

[75] Inventors: Kiyoshi Suenaga; Yoshikuni Kasai, both of Takasago, Japan

[73] Assignee: Mitsubishi Jukogyo Kabushiki Kaisha, Tokyo, Japan

[21] Appl. No.: 860,589

[22] PCT Filed: Nov. 21, 1996

[86] PCT No.: PCT/JP96/03416

§ 371 Date: Jul. 8, 1997

§ 102(e) Date: Jul. 8, 1997

[87] PCT Pub. No.: WO97/19256

PCT Pub. Date: May 29, 1997

[30] Foreign Application Priority Data

Nov. 24, 1995 [JP] Japan ..... 7-305668

[51] Int. Cl.[6] ..... F04D 29/58

[52] U.S. Cl. ..... 416/95; 416/96 R

[58] Field of Search ..... 416/96 R, 95

[56] References Cited

U.S. PATENT DOCUMENTS

| | | | |
|---|---|---|---|
| 4,830,575 | 5/1989 | Bandukwalla | 416/95 |
| 5,318,404 | 6/1994 | Carreno et al. | 416/96 R |
| 5,558,496 | 9/1996 | Woodmansee et al. | 416/96 R |
| 5,593,274 | 1/1997 | Carreno et al. | 416/96 R |
| 5,695,319 | 12/1997 | Matsumoto et al. | 416/95 |

FOREIGN PATENT DOCUMENTS

| | | |
|---|---|---|
| 61-226502 | 10/1986 | Japan . |
| 7-189739 | 7/1995 | Japan . |
| 8-14064 | 1/1996 | Japan . |

*Primary Examiner*—John T. Kwon

*Attorney, Agent, or Firm*—Wenderoth, Lind & Ponack, L.L.P.

[57] ABSTRACT

Disclosed is a gas turbine rotor (5) having multi-stage moving blades, each fitted to a disc (12), characterized in comprising: an inner cavity (9) and an outer cavity (8) provided between each disc (12); a blade cooling passage (6) of each moving blade except a rearmost stage moving blade (4); a cooling steam supply passage (13) extending from a rear portion of the rearmost stage moving blade (4) to a leading edge portion of a foremost stage moving blade (1) in the rotor (5); a bifurcation passage (16) provided in the disc (12) portion of the foremost stage so as to connect at its proximal end to the cooling steam supply passage (13) and to bifurcate at its distal end so that one bifurcation thereof (16*a*) connects to one end of the blade cooling passage (6) and the other bifurcation (16*b*) connects to the outer cavity (8); a blade return passage (17) connecting at its proximal end to the other end of the blade cooling passage (6) and at its distal end to the inner cavity (9); a cavity connecting passage (20) for connecting each inner cavity (9); a return passage (11) extending along the cooling steam supply passage (13) from the inner cavity (9) of the rearmost stage moving blade (4); a blade connecting passage (18) provided in each disc (12) except the discs (12) of the foremost stage and the rearmost stage for connecting the blade cooling passage (6) and the outer cavity (8); an inter-cavity passage (19) for connecting the outer cavity (8) and the inner cavity (9) both of the rearmost stage.

1 Claim, 4 Drawing Sheets

HEAT RECOVERY TYPE GAS TURBINE ROTOR

BACKGROUND OF THE INVENTION

1. Field of the Invention

The present invention relates to a heat recovery type gas turbine rotor that is applicable to a blade cooling of a high temperature industrial gas turbine used in a combined plant etc.

2. Description of the Prior Art

Cooling of a conventional gas turbine moving blade is done in two ways, one being an air cooling type and the other being a recovery type by way of steam cooling.

In the air cooling type, as shown in FIG. 4, there is provided a cavity 8*a* between each disc 12 and also provided is a cavity connecting passage 20 connecting each said cavity 8*a* and connecting the cavity 8*a* and a front portion of a first stage disc. Thus, cooling air 14 is supplied from a leading edge portion of each stage moving blade 1 to 4 and, after cooling each said moving blade, is discharged into an interior of the turbine from a trailing edge portion 15 of each blade.

In the recovery type by way of steam cooling, as shown in FIG. 3, there is provided a cooling steam supply passage 13, within a rotor 5, extending from a rear portion of a fourth stage moving blade 4 to a leading edge portion of a first stage moving blade 1 and also provided is a cavity 8*a* between each disc 12. Further, a return passage 11 is provided extending rearwardly from the cavity 8*a* of the disc of the fourth stage moving blade so as to pass through this disc.

Also, in the portion of the first stage moving blade 1 to a third stage moving blade 3, flow passages are provided in series each so as to pass through a blade cooling passage 6 and the cavity 8*a*, starting from a front end portion of the cooling steam supply passage 13 via the disc of the first stage moving blade 1.

By use of said structure, cooling steam is supplied from the cooling steam supply passage 13 to cool the first stage moving blade 1 to the third stage moving blade 3 sequentially and returns through the return passage 11.

In said gas turbine blade of the air cooling type, compressor discharge air is used for the cooling, and cooling medium (air), after used, is discharged into the turbine. In a large capacity industrial gas turbine, however, use of a combined cycle plant in combination with a steam turbine is now a main tendency, and it is currently required that steam derived therefrom is made use of for cooling and heat obtained by the cooling is used for a steam cycle, thereby to enhance a combined cycle plant efficiency.

Also, in the recovery type by way of steam cooling in series as one system, there is such a problem that steam temperature in the latter stages becomes too high to cool the moving blades of the latter stages.

It is therefore an object of the present invention to dissolve said problems in the prior art.

SUMMARY OF THE INVENTION

In order to attain said object, the present invention provides a heat recovery type gas turbine rotor having multi-stage moving blades, each fitted to a disc, characterized in comprising: an inner cavity and an outer cavity provided between each said disc; a blade cooling passage erecting from a root portion of each of said moving blades except a rearmost stage moving blade and making U-turn at a tip portion thereof; a cooling steam supply passage extending from a rear portion of the rearmost stage moving blade to a leading edge portion of a foremost stage moving blade in said gas turbine rotor; a bifurcation passage provided in the disc portion of the foremost stage so as to connect at its proximal end to said cooling steam supply passage and to bifurcate at its distal end so that one bifurcation thereof connects to one end of said blade cooling passage and the other bifurcation connects to said outer cavity which is adjacent thereto; a blade return passage provided in the disc portion of the foremost stage so as to connect at its proximal end to the other end of said blade cooling passage and at its distal end to said inner cavity which is adjacent thereto; a cavity connecting passage for connecting each said inner cavity; a return passage extending along said cooling steam supply passage from said inner cavity of the rearmost stage moving blade; a blade connecting passage provided in each said disc except the discs of the foremost stage and the rearmost stage for connecting said blade cooling passage and said outer cavity which is adjacent thereto; an inter-cavity passage for connecting said outer cavity and said inner cavity which are both adjacent to the rearmost stage moving blade.

By employing said construction, steam supplied from the cooling steam supply passage passes through the blade cooling passage of the foremost stage moving blade via the one bifurcation to cool this moving blade and returns via the blade return passage, the inner cavity, the cavity connecting passage and the return passage. Thus, the foremost stage moving blade at which the thermal load is severest is cooled sufficiently.

On the other hand, at the second and subsequent stage moving blades, the steam passes through the blade cooling passage of each moving blade via the other bifurcation, the outer cavity and the blade connecting passage to cool each moving blade sequentially and returns via the outer cavity and the inner cavity, both of the rearmost stage moving blade, and the return passage.

Thus, the second and subsequent stage moving blades at which the thermal load is less severe are cooled by a cooling steam of separate system from the above-mentioned cooling system. Accordingly, by selecting an optimal flow splitting ratio at the bifurcation passage, the foremost stage moving blade and the second last stage moving blade can be set to and maintained at approximately same temperature. It is to be noted that the steam so returned is used otherwise for head recovery.

DESCRIPTION OF THE PREFERRED EMBODIMENTS

One embodiment according to the present invention is described with reference to FIGS. 1 and 2.

Figure 1:
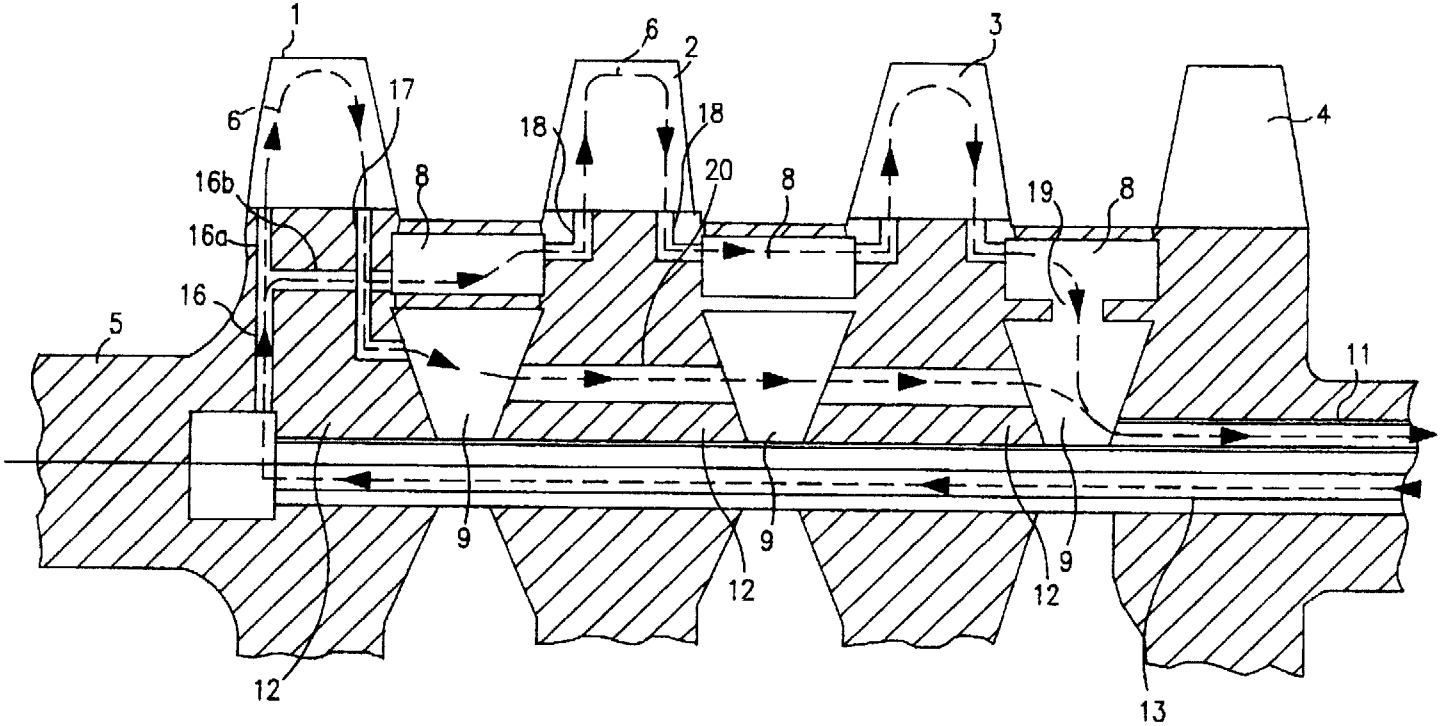
FIG. 1 is a cross sectional view of one embodiment according to the present invention.

In FIG. 1, there are shown first to fourth stage moving blades 1 to 4, each fitted to a respective disc 12 of a high temperature gas turbine rotor 5. An inner cavity 9 and an outer cavity 8 are provided between each disc 12.

In each of the moving blades 1 to 3 except the fourth stage moving blade 4, there is provided a blade cooling passage 6 erecting from a root portion thereof and making U-turn at a tip portion thereof.

Also, provided in the gas turbine rotor is a cooling steam supply passage 13 extending from a rear portion of the fourth stage moving blade 4 to a leading edge portion of the first stage moving blade 1.

A bifurcation passage 16 which is provided in the disc 12 portion of the first stage moving blade 1 connects at its proximal end to a front end portion of the cooling steam supply passage 13 and bifurcates at its distal end so that one bifurcation thereof 16*a* connects to one end of the blade cooling passage 6 and the other bifurcation 16*b* connects to the outer cavity 8 which is adjacent thereto. Also, a blade return passage 17 which is provided in the disc 12 portion of the first stage moving blade 1 connects at its proximal end to the other end of the blade cooling passage 6 and at its distal end to the inner cavity 9 which is adjacent thereto.

A cavity connecting passage 20 connects each said inner cavity 9 which is provided arrayedly in the axial direction. Also, a return passage 11 is provided extending along the cooling steam supply passage 13 toward a rear direction from the inner cavity 9 (in front) of the fourth stage moving blade 4.

A blade connecting passage 18 which is provided in each said disc 12 portion except the first stage disc and the fourth stage disc connects the blade cooling passage 6 and the outer cavity 8 which is adjacent thereto. Also, an inter-cavity passage 19 connects the outer cavity 8 and the inner cavity 9 which are in front of and adjacent to the fourth stage moving blade 4.

By employing said construction, steam supplied from the cooling steam supply passage 13 passes through the blade cooling passage 6 of the foremost stage moving blade 1 via the one bifurcation 16*a* of the bifurcation passage 16 to cool this moving blade and returns via the blade return passage 17, the inner cavity 9, the cavity connecting passage 20 and the return passage 11. Thus, the foremost stage moving blade 1 at which the thermal load is severest is cooled sufficiently.

On the other hand, at the second stage moving blade 2 and the third stage moving blade 3, the steam passes through the blade cooling passage 6 of each said moving blade via the other bifurcation 16*b* of the bifurcation passage 16, the outer cavity 8 and the blade connecting passage 18 to cool each said moving blade sequentially and returns via the outer cavity 8 and the inner cavity 9, both (in front) of the rearmost stage moving blade 4, and the return passage 11.

Thus, the second and subsequent stage moving blades at which the thermal load is less severe are cooled by a cooling steam of separate system from the above-mentioned cooling system. Accordingly, by selecting an optimal flow splitting ratio at the bifurcation passage, the foremost stage moving blade and the second last stage moving blade can be set to and maintained at approximately same temperature.

Figure 2:
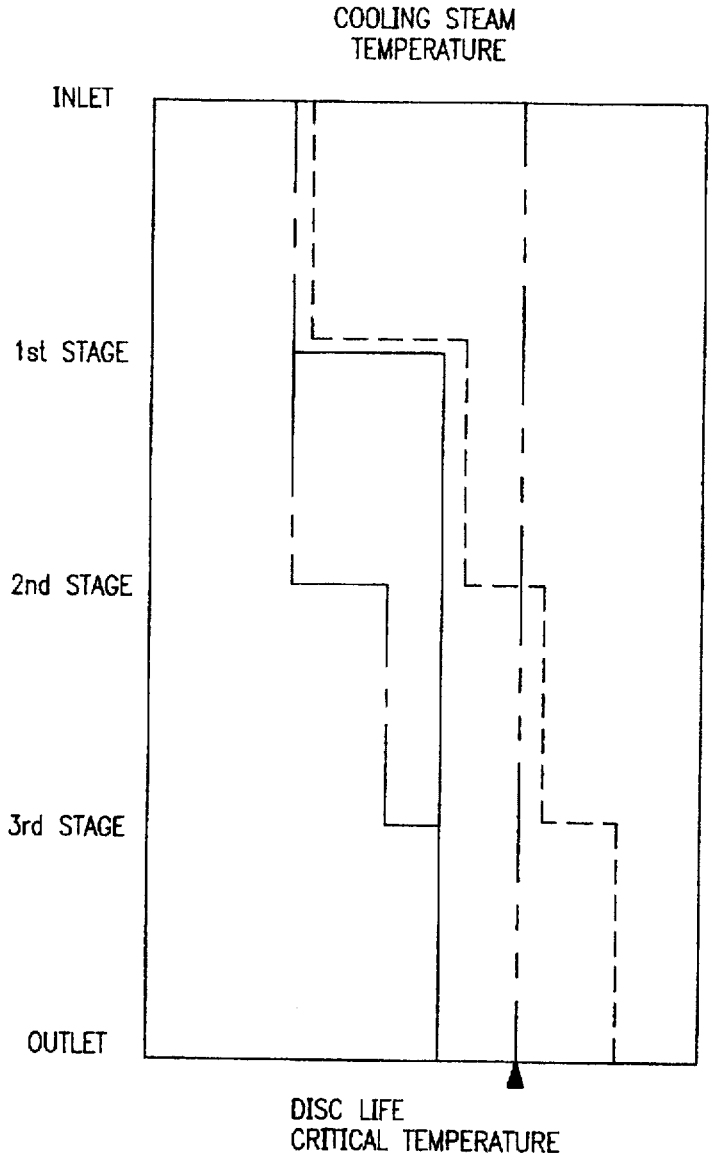
FIG. 2 is an explanatory view of function of said embodiment.
Figure 3:
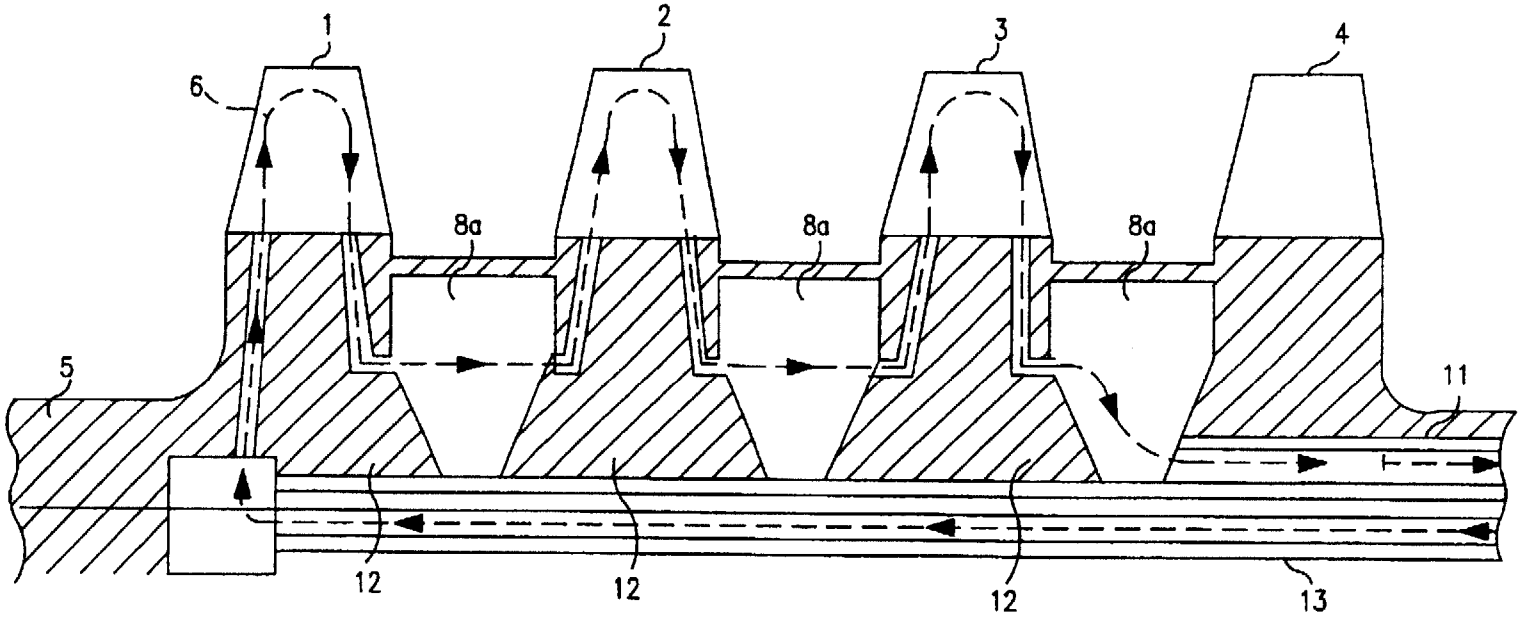
FIG. 3 PRIOR ART
FIG. 3 is a cross sectional view of a prior art example.
Figure 4:
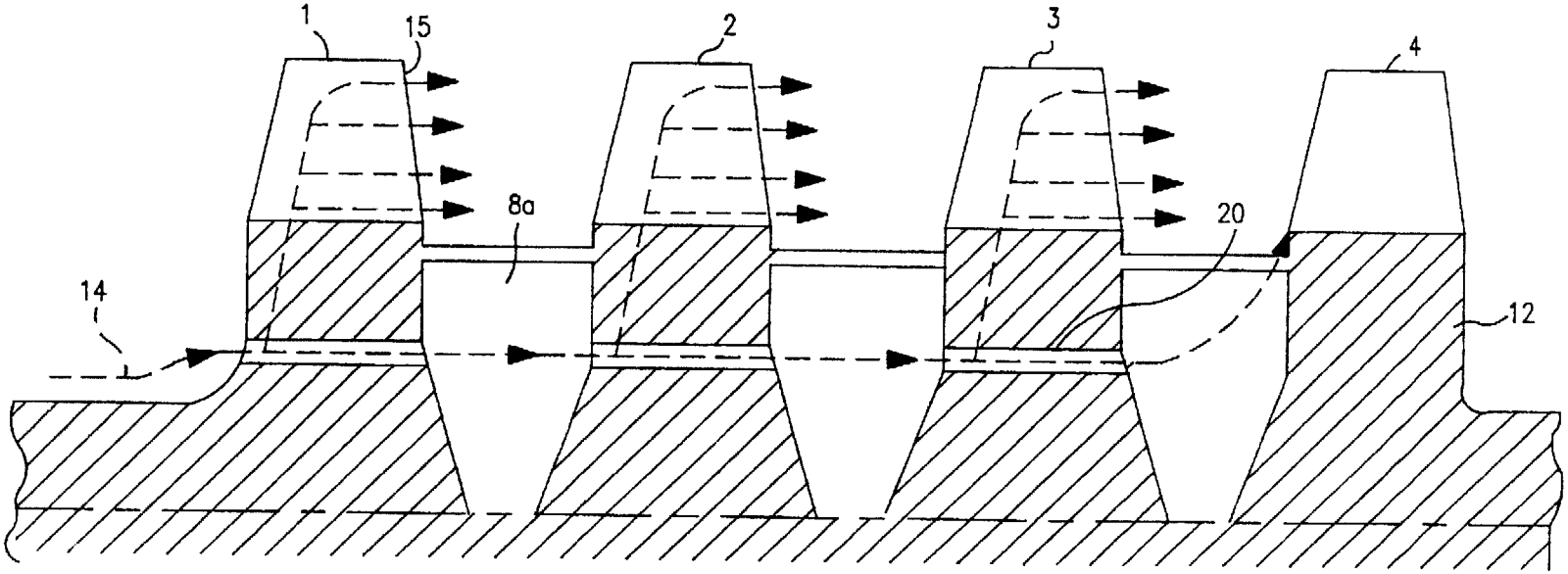
FIG. 4 PRIOR ART
FIG. 4 is a cross sectional view of another prior art example.

State of cooling steam temperature at each stage is shown in FIG. 2 by a line and a chain line. The line shows the system passing through the bifurcation 16*a* and the chain line shows the system passing through the bifurcation 16*b*. Also, a broken line shows a case of one cooling system in the prior art as shown in FIG. 3. As is known from the figure, in case of the present embodiment where two cooling systems are used, the cooling steam temperature of each of the moving blades 1 to 3 and 4 can be maintained below a disc life critical temperature as shown by a chain double-dashed line.

While the preferred form of the present invention has been described, variations thereto will occur to those skilled in the art within the scope of the present inventive concepts which are delineated by the claims appended below.

INDUSTRIAL APPLICABILITY

As explained in the above, according to the present invention, two systems of the cooling steam passage are provided, thereby it becomes possible that the multi-stage moving blades and each disc portion are applied by an efficient steam cooling, thus a risk of creep fracture of the disc material, etc. can be prevented and a heat recovery type steam cooling of high reliability can be realized. Accordingly, the present invention is applicable excellently to blade cooling of a high temperature industrial gas turbine used in a combined cycle plant etc.

What is claimed is:

1. A heat recovery type gas turbine rotor having multi-stage moving blades, each fitted to a disc, and comprising: an inner cavity and an outer cavity provided between each said disc; a blade cooling passage erecting from a root portion of each of said moving blades except a rearmost stage moving blade and making U-turn at a tip portion thereof; a cooling steam supply passage extending from a rear portion of the rearmost stage moving blade to a leading edge portion of a foremost stage moving blade in said gas turbine rotor; a bifurcation passage provided in the disc portion of the foremost stage so as to connect at its proximal end to said cooling steam supply passage and to bifurcate at its distal end so that one bifurcation thereof connects to one end of said blade cooling passage and the other bifurcation connects to said outer cavity which is adjacent thereto; a blade return passage provided in the disc portion of the foremost stage so as to connect at its proximal end to the other end of said blade cooling passage and at its distal end to said inner cavity which is adjacent thereto; a cavity connecting passage for connecting each said inner cavity; a return passage extending along said cooling steam supply passage from said inner cavity of the rearmost stage moving blade; a blade connecting passage provided in each said disc except the discs of the foremost stage and the rearmost stage for connecting said blade cooling passage and said outer cavity which is adjacent thereto; an inter-cavity passage for connecting said outer cavity and said inner cavity which are both adjacent to the rearmost stage moving blade.

* * * * *